US005094022A

United States Patent [19]

Rutchik

[11] Patent Number: 5,094,022

[45] Date of Patent: Mar. 10, 1992

[54] DISPLAY DEVICE

[75] Inventor: Robert K. Rutchik, Lyons, Ill.

[73] Assignee: Rapid Mounting And Finishing Company, Chicago, Ill.

[21] Appl. No.: 315,504

[22] Filed: Feb. 27, 1989

[51] Int. Cl.[5] ..... G09F 7/00

[52] U.S. Cl. ..... 40/488; 40/476

[58] Field of Search ..... 40/488, 486, 487, 476, 40/491; 116/42, 44

[56] References Cited

U.S. PATENT DOCUMENTS

| | | | |
|---|---|---|---|
| 2,799,105 | 7/1957 | Tilley | 40/488 |
| 2,833,066 | 5/1958 | Morrissey | 40/488 |
| 3,403,465 | 10/1968 | Lane | 40/491 |
| 3,430,371 | 3/1969 | Phillips | 40/486 |
| 3,430,372 | 3/1969 | Rutchick | 40/486 |
| 4,087,929 | 5/1978 | Ruger | 40/488 |

FOREIGN PATENT DOCUMENTS

| | | | |
|---|---|---|---|
| 643923 | 7/1962 | Canada | 40/486 |
| 6613699 | 3/1968 | Netherlands | 40/488 |
| 2197519 | 5/1988 | United Kingdom | 40/486 |

*Primary Examiner*—Kenneth J. Dorner
*Assistant Examiner*—Brian K. Green
*Attorney, Agent, or Firm*—Willian Brinks Olds Hofer Gilson & Lione

[57] ABSTRACT

A display device is provided consisting of a first display panel having a first forwardly facing substantially flat surface carrying a first message to be displayed with a cut in the first display panel to divide the first display plane into a plurality of sections which cooperatively produce the first message, a second display panel having a second forwardly facing substantially flat surface for carrying a second message to be displayed and also having a cut to divide the second display panel into a plurality of separate sections which cooperatively produce the second message, structure for guiding relative movement between the first and second display panels in a predetermined path between first and second relative position for the first and second display panels, structure on the first and second display panels for intermeshing the sections on the first and second display panels with the first and second display panel surfaces facing in the same direction and for causing the first message to be exposed for viewing at the front of the display device with the first and second display panels in the first relative position and for causing the second message to be exposed for viewing at the front of the display device with the first and second display panels in the second relative position, a tab on one of the plurality of sections on one of the first and second display panels that projects through the cut in the other of the first and second display panels at all times throughout the range of movement of the first and second display panels between the first and second positions. It is another aspect of the invention to configure the panel cuts so that the panels can be moved without binding between said first and second relative positions without the need for cut-outs/reliefs contiguous with the cuts.

11 Claims, 3 Drawing Sheets

DISPLAY DEVICE

BACKGROUND OF THE INVENTION

1. Field of the Invention

This invention relates to display devices of the type using relatively movable, intermeshing display panels and, more particularly, to structure for facilitating the intermesh of the display panels without interference therebetween.

2. Background Art

It is known to utilize "dissolve displays" to selectively produce different messages for viewing. It is known, for example, to provide a display panel with cuts therein to define sections that intermesh in a predetermined manner with sections on a like display panel and to change the relative positions of the display panels to thereby selectively expose for viewing different messages.

In one such prior art device, two panel assemblies are provided, with each panel assembly carrying a message to be displayed. Each panel assembly consists of two layers with overlapping sections. Each section on each panel assembly is guided between two overlapping sections on the other panel assembly. Relative shifting between the panel assemblies selectively exposes the message on one or the other of the panel assemblies depending upon the relative positions thereof. Because the sections on each panel assembly are guided between two overlapping sections on the other panel assembly, there is no interference between the edges of the panel sections as the panels shift guidingly against each other as the messages are changed. Such a device is thus not prone to jamming.

The above prior art device has proven very effective in operation. One drawback with this prior art device, however, is that manufacture thereof requires the assembly and intermeshing of four different sheet layers to have the potential to produce two different messages on one side thereof.

Another problem with the above prior art device is that it requires accurate registration of the message parts on the sections of each display assembly. That is, because the sections on each display assembly are overlapping, the message must properly blend between the overlying and underlying sections in each panel assembly to produce the desired image.

A further problem with prior art display structures is that they require selected parts of the display panels to be cut out and removed. The cut-outs/reliefs are provided to prevent binding between intermeshed display panels as they are moved relative to each other. Cut-outs, however, create two problems. First, the cut-outs must be pressed out of the panels once they are severed therefrom. The cut-outs, which may be very small, have a tendency to adhere to the panel from which they are struck. Second, the cut-outs must be cleaned up and disposed of by the manufacturer, which is an obvious inconvenience.

SUMMARY OF THE INVENTION

The present invention is specifically directed to overcoming the above enumerated problems in a novel and simple manner.

According to the invention, a display device is provided consisting of a first display panel having a first forwardly facing substantially flat surface carrying a first message to be displayed with a cut in the first display panel to divide the first display panel into a plurality of sections which cooperatively produce the first message, a second display panel having a second forwardly facing substantially flat surface for carrying a second message to be displayed and also having a cut to divide the second display panel into a plurality of separate sections which cooperatively produce the second message, structure for guiding relative movement between the first and second display panels in a predetermined path between first and second relative positions for the first and second display panels, structure on the first and second display panels for intermeshing the sections on the first and second display panels with the first and second display panel surfaces facing in the same direction and for causing the first message to be exposed for viewing at the front of the display device with the first and second display panels in the first relative position and for causing the second message to be exposed for viewing at the front of the display device with the first and second display panels in the second relative position, a tab on one of the plurality of sections on one of the first and second display panels that projects through the cut in the other of the first and second display panels at all times throughout the range of movement of the first and second display panels between the first and second positions.

It is possible with the above structure to display selectively two different messages on one side of the display device simply through the use of two display panels each consisting of only a single sheet layer. The two sheets are cut so that in the first relative position, the first message is produced entirely by the first display panel sheet, while in the second relative position, the message is produced entirely by the second display panel sheet. The invention also contemplates the provision of messages on both sides of the display panels. This makes possible both a two-sided display device and reversal of the display panels in the field.

The tab on one display panel leads its respective section through the cut in the other display panel so that transition between the two relative positions occurs smoothly and without hang-up or jamming. Preferably a tab is provided on a section associated with each of the display panels so that transition back and forth between the first and second relative positions is facilitated.

Preferably, the section on which each tab is carried is progressively directed through the cut in the receptive display panel as the display panels are relatively repositioned. For example, a V-shaped cut may be provided, with the tab at the apex of the V. The V-shaped edge defined by the cut in one display panel progressively follows the tab smoothly through the cut in the other display panel.

The invention also contemplates that the tabs be located on their respective section so as to be covered by a frame within which the display panels are mounted so as not to be visible from the front of the display device. For example, the tabs can be at the top of the device behind a frame.

It is another aspect of the invention to provide the cuts on the display panels in transverse relationship to each other. This prevents any entanglement between the sections on the separate display panels as the device is in transition during changing of the messages.

Structure is provided to automatically, reciprocatively move one of the display panels between the first and second relative positions therefor.

The present invention facilitates assembly not only by reason of requiring only two separate sheets to selectively produce different messages but also by permitting each sheet to be preprinted with an entire, self-contained message. Thereafter, the preprinted display sheets can be cut to define the aforementioned sections and readily assembled, one with the other, and incorporated into a cabinet, or the like.

It is a further aspect of the present invention to permit the aforementioned intermeshing of an relative movement between panels without the necessity of providing cut-out/reliefs in the panels. The cuts in the display panels are configured so that cooperating portions are defined thereby on the panels at the ends of the cuts, which panel portions are sufficiently flexible so as to permit relatively uninhibited movement of the display panels between their first and second relative positions. In a preferred form, the cuts defining the display panel sections have U-shaped portions adjacent their ends. The U-shaped cut portions define U-shaped edges, which on one panel open in one direction and on the other panel open in a direction opposite to the one direction. The U-shaped edges intermesh with each other with the panels in one of their first and second relative positions.

With the above structure, the cuts can be impressed in the panels without forming cut-outs/reliefs While cut-outs can be made in other portions of the display panels, with the inventive structure it is not necessary that any cut-outs be made in the panels, contiguous with the cuts defining the display panel sections, to permit the proper intermeshing and relatively uninhibited movement of the panels between their first and second relative positions.

DETAILED DESCRIPTION OF THE DRAWINGS

Figure 1:
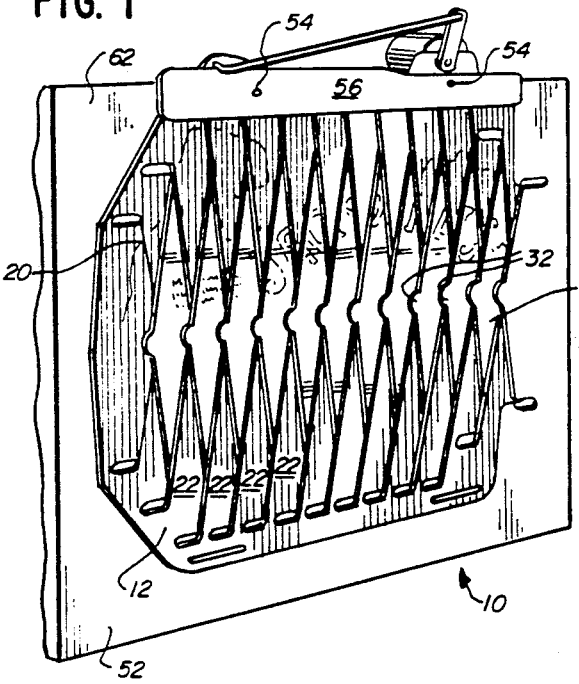
FIG. 1 is a front perspective view of a display device according to the invention with two display panels each carrying a separate message shown and with the panels in a transition state as the message is being changed.
Figure 3:
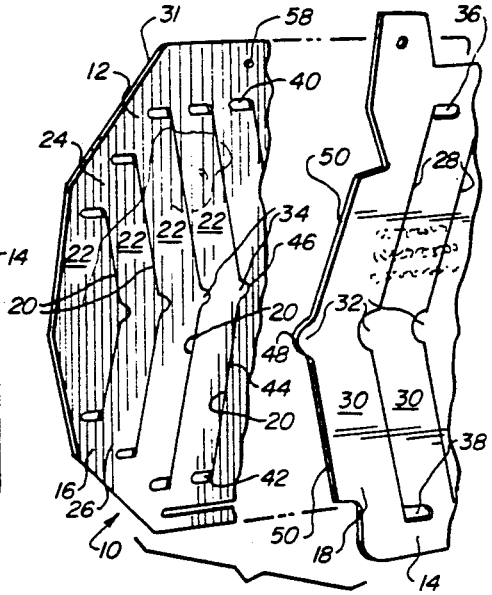
FIG. 3 is an enlarged, fragmentary, exploded perspective view of the display panels in FIGS. 1 and 2.
Figure 2:
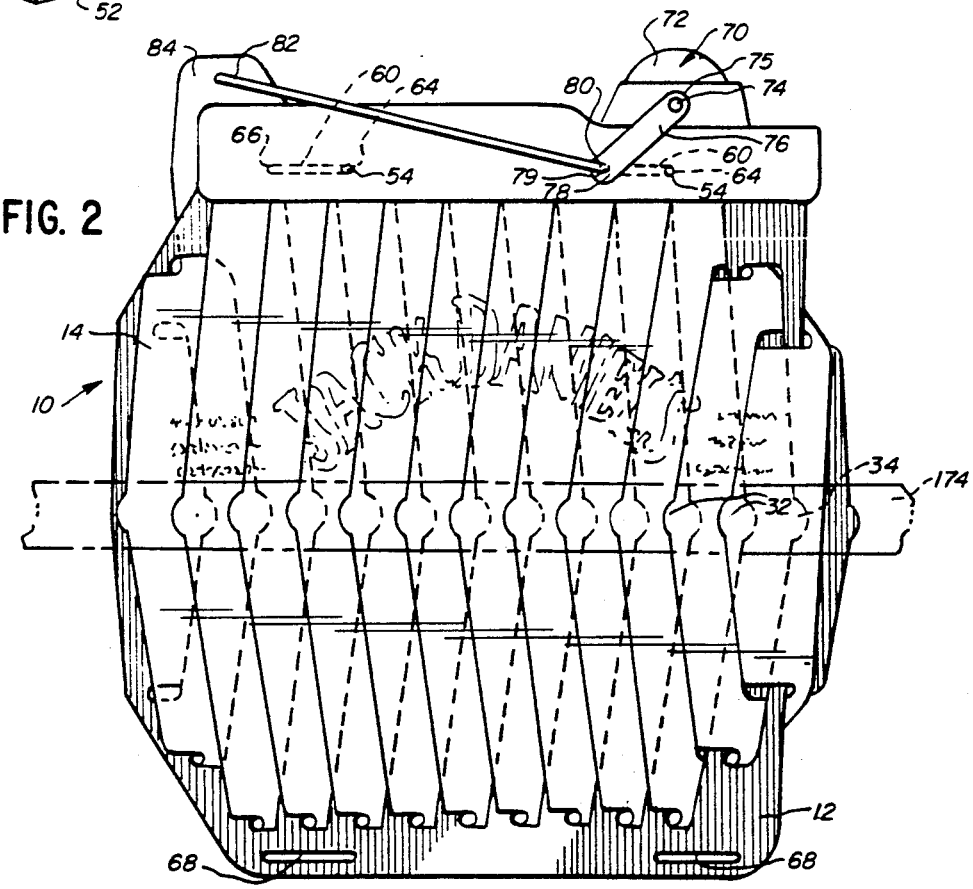
FIG. 2 is an enlarged, front elevation view of the display device of FIG. 1 with one message exposed for viewing.

In FIGS. 1-3, one form of display device according to the present invention is depicted at 10. The device 10 in FIGS. 1-3 is designed to selectively produce two different messages for viewing at the front of the display device 10. A first message is carried on a first display panel 12 and a second message is carried on a second display panel 14. It should be understood that while messages are shown only at the front of each of the first and second display panels 12, 14, the back side of each of the display panels 12, 14 could be provided with an additional message to make the device 10 more versatile.

Each display panel 12, 14 is preferably made from a thin sheet of material, such as cardboard, so that it is light in weight and flexible. The flat front surface 16 of the display panel 12 carries its own complete message. Similarly, the flat front surface 18 of the second display panel 14 carries its own complete message. Part of the message on the panel 12 is seen in FIG. 3, while the full message on the panel 14 is seen in FIG. 2. The particular overall shape of each of the panels 12, 14 and the contents of the message are design considerations.

The first display panel 12 has a plurality of generally aligned, regularly spaced, V-shaped cuts 20 opening to the left in FIGS. 1-3, which divide the panel 12 into a plurality of flexible display sections 22. The sections 22 are integral with the panel 12 at their top and bottom portions, 24, 26 respectively, and deformable between the top and bottom portions 24, 26 out of the plane of the front surface 16. The second display panel 14 has a similar configuration to the first panel 12 and also has generally V-shaped cuts 28 therein, opening to the right in FIGS. 1-3, to divide the panel 16 into a plurality of sections 30, likewise deformable out of the plane of the front surface 18 of the second panel 14.

The first and second display panels 12, 14 are operatively connected by first placing the rear surface 31 of the first display panel 12 facially against the flat front surface 18 of the second display panel 14. The panels 12, 14 are relatively laterally positioned so that curved tabs 32 on the panel 14 underlie similar tabs 34 on the panel 16 across the width of the panels 12, 14.

To intermesh the panel sections 22, 30, all of the tabs 32 on the panel 14 are directed upwardly through the cuts 20 in the first panel 12 along the entire width of the device 10 so that each tab 32 on the panel 14 projects through a cut 20 in panel 12 and overlies a tab 34 on the panel 12. Resultingly, each tab 34 on the panel 12 projects through a cut 28 in the panel 14 and underlies the tab 32 on the panel 14.

By thereafter shifting the panels 12, 14 relative to each other i.e. the first panel 12 towards the right in FIGS. 1-3 relative to the second panel 14 and/or the second panel 14 to the left relative to the first panel 12, the sections 30 on the display panel 14 move progressively through the cuts 20 on the panel 12 so that a progressively increasing area of the surface 18 is exposed for viewing at the front of the device 10 until the message on the panel 14 is completely exposed, as shown in FIG. 2. By reversing the relative movement between the panels 12, 14, from that just described and from their FIG. 2 position, the area of surface 16 exposed for viewing increases progressively until substantially only the surface 16 is visible from the front of the device 10.

At the top and bottom of the cuts 28 on the panel 14 there are cut-outs 36, 38, respectively, which co-act with like cut-outs 40, 42 at the top and bottom of the panel 12 to prevent interference between the sections 22, 30 with the surface 18 completely exposed for viewing from the front of the device 10 (i.e. with the panel 14 shifted fully to the left relative to the panel 12, as in FIG. 2). In the absence of the cut-outs 36, 38, 40, 42 the sections 22, 30 would interfere with each other upon the top and bottom of the cuts 20, 28 coming together as the message is being changed and would thereby prevent the FIG. 2 position from being fully realized.

According to the invention, the tabs 32, 34 project through the cuts 20, 28, respectively, throughout the operative range of the device 10 between a first position, wherein the message on the first panel 12 is completely exposed for viewing at the front of the device 10, and a second relative position, wherein the message on the second display panel is completely exposed for viewing at the front of the device 10. The cuts 20 each define a V-shaped guiding edge 44, facing generally towards the right in FIG. 3, and diverging away from a leading free edge 46 on the tab 34. Similarly, cuts 28 define a leading free edge 48 on the tabs 32 which blends into a diverging V-shaped edge 50. The diverging edges 44, 50 progressively guide their respective sections 22, 30 through the cuts 28, 20, respectively. Because the tabs 32, 34 at all times project through the cuts 20, 28, respectively, there will be no interference between the panel sections 22, 30 as the message is changed from one to the other, which interference could potentially jam operation of the device 10.

To confine the range of relative movement between the first and second panels 12, 14, one of the panels 12 is preferably fixed to a cabinet 52 on which the panels 12, 14 are mounted, and the other of the panels 14 is mounted for movement relative to the fixed panel 12 and the cabinet 52 to which it attaches. In the embodiment in FIGS. 1-3, studs 54 are directed through a front cover strip 56, holes 58 (one shown in FIG. 3) in the panel 12 and slots 60 in the panel 14 and into the front wall 62 of the cabinet 52. With the panel 14 shifted fully to the left relative to the panel 12, as in FIG. 2, the studs 54 abut the slot ends 64 to arrest further movement of the panel 14 to the left. In this position, the message on panel surface 18 is completely exposed for viewing at the front of the device 10. Shifting of the panel 14 to the right in FIG. 2 relative to the panel 12 is limited by the studs 54 which encounter the opposite end 66 of the slot 60. In this position the message on the panel 12 is completely exposed for viewing. In this latter position, the tabs 32 still project slightly through the cuts 20 and are visible from the front of the device 10.

It is possible to connect both panels 12, 14 to the cabinet 52 and each other only at their top edges. However, optional slots 68 may be provided in the panel 12 to guide a stud (not shown) extending through the panel 14.

To automatically alternatingly display the two different messages, a motor assembly is provided at 70. The motor assembly consists of an electric motor 72 having a rotary shaft 74 connected to one end 75 of a crank arm 76. The motor may be battery powered or supplied by a conventional A.C. power source. The opposite end 78 of the crank arm 76 pivotally accepts an offset end 79 of an elongate rod 80. The opposite end 82 of the rod 80 is offset and directed through an integral vertical extension 84 of one of the panel sections 30. Operation of the motor 70 causes the extension 84 and thereby its associated panel 14, to translate in a reciprocating path. At each extremity of that path the first and second messages are displayed for viewing at the front of the device 10. As an alternative to the use of a motor to effect the change of messages, the panels 12, 14 could, of course, be manually controlled. Further, the particular location on the panel where the drive is attached is not limited to that described herein.

The tabs 32, 34, which at all times project through the cuts 20, 28, lead their respective sections 30, 22 through the cuts 20, 28 with the V-shaped edges 44, 50 facilitating smooth, progressive movement of the sections 22, 30 through the cuts 28, 20. The cuts 20, 28, pass by each other during message change with the edges 44, 50 transverse to each other so that there is no interference between the panel sections 22, 30 as the display device is operated.

It can be seen that the present invention permits each of the display panels 12, 14 to be preprinted with the desired message thereon and thereafter the cuts 20, 28 can be simply made therein to permit assembly of the two panels 12, 14. This obviates the problem of having to register parts of the message on each panel as in prior art devices.

Figure 4:
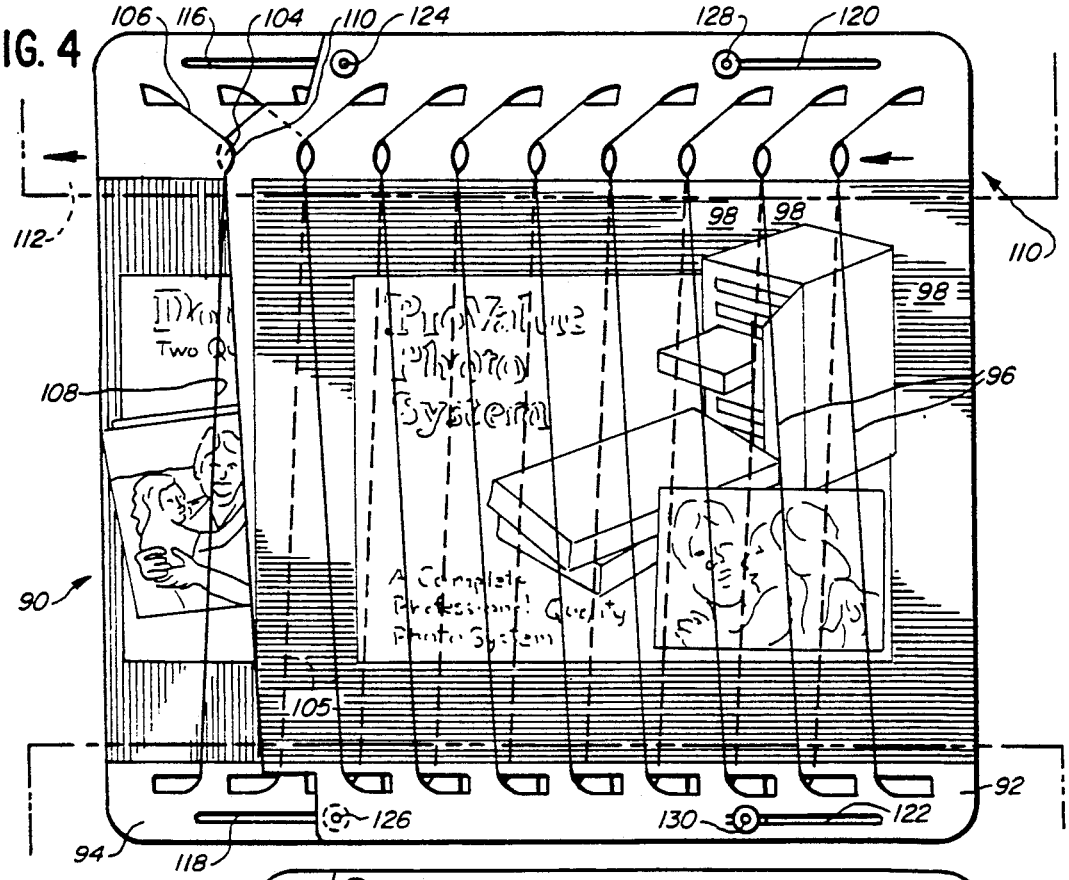
FIG. 4 is a front elevation view of a modified form of display device according to the present invention with one of two messages producible thereby displayed for viewing.
Figure 5:
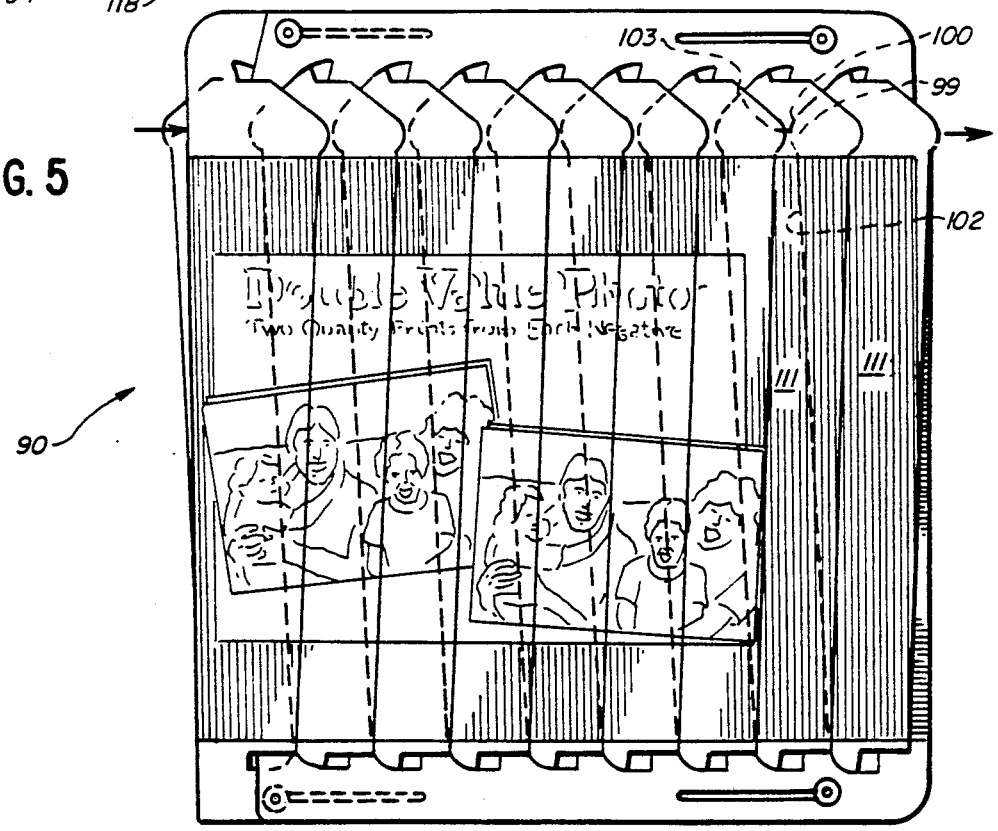
FIG. 5 is a view similar to that in FIG. 4 with a second message displayed for viewing.

A modified form of the inventive device is shown in FIGS. 4 and 5 at 90. The device in FIGS. 4 and 5 is similar to that in FIGS. 1-3 and has panels 92, 94, each carrying its own, self-contained message. The panel 92 has cuts 96 dividing the panel 92 into a plurality of sections 98, each of which has an integral tab 99. Edges 100, 102 diverge away from the leading free edge 103 of each tab 99 and co-operatively define a substantially V-shape. The panels 94 have a tab 104 and cuts 105 defining guiding edges 106, 108 diverging away from the free leading edge 110 of the tab 104. The cuts 105 divide the panel 94 into sections 111.

The principal distinction between the device 90 in FIGS. 4 and 5 and that in FIGS. 1-3 is that the tabs 99, 104 cooperate with each other at the upper portion 110 of the device 90 rather than at the middle thereof. As the tabs 32, 34 in the prior embodiment, the tabs 99, 104 on each panel 92, 94 project through cuts on the other panel 92, 94 throughout the permitted range of relative movement of the panels 92, 94. The tabs 99, 104 could also be located at the bottom of the device 90. In the device 90, an optional cover/frame 112 is provided to shield the tabs 99, 104 so that the tabs 99, 104 are not visible from the front of the device 90.

In all other respects, the device 90 operates in similar fashion to that shown in FIGS. 1-3. The edges 106, 108 on panel 94 cooperatively form an overall V-shape opening to the left in FIGS. 4 and 5, while the edges 100, 102 define an overall V-shape opening towards the right in FIGS. 3 and 4. The edges 106, 108 and edges 100, 102 always remain transverse to each other as the panels shift against each other during message change and thus the panel sections 98, 11 slide smoothly against each other without hang-up.

To guide relative movement between the panels 92, 94, elongate slots 116, 118 are provided at the top and bottom of panel 94 and slots 120, 122 are provided at the top and bottom of panel 92. Studs 124, 126 extend through the top and bottom of the panel 92 and are guided in the slots 116, 118 respectively. Studs 128, 130 extend through panel 94 and are guided in slots 120, 122 respectively. The slots 116, 118, 120, 122 and studs 124, 126, 128, 130 cooperatively limit the range of relative movement between the panels 92, 94.

Figure 6:
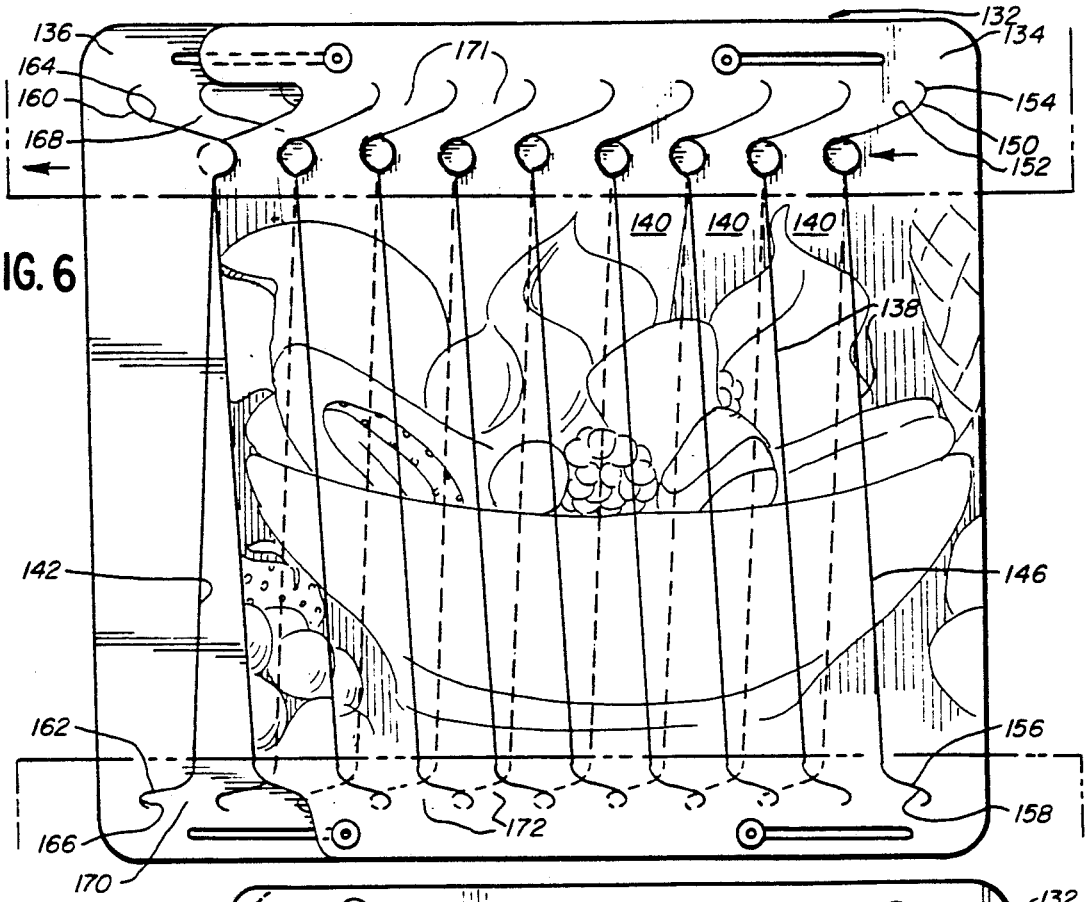
FIG. 6 is a front elevation view of a further modified form of display device according to the present invention with one of two messages producible on one side of the display exposed for viewing.
Figure 7:
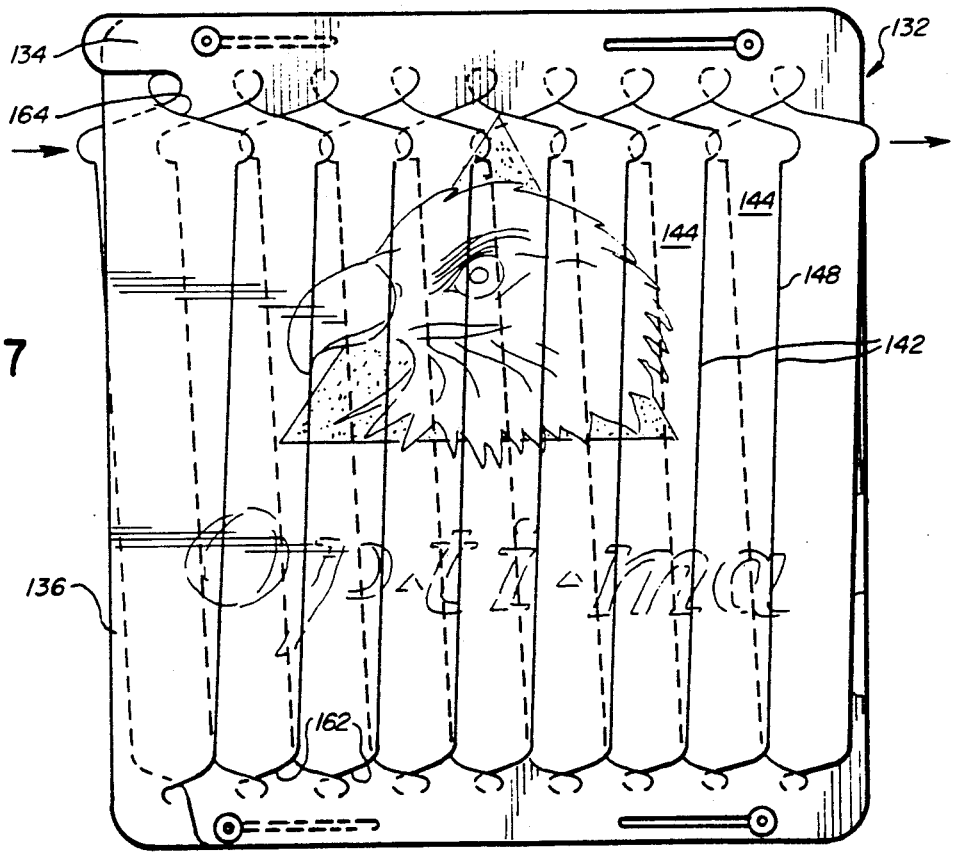
FIG. 7 is a view similar to that in FIG. 6 with a second message exposed for viewing.

A further aspect of the invention is embodied in the display device at 132 in FIGS. 6 and 7. The display device 132 consists of facially engaged display panels 134, 136. The display panel 134 has cuts 138 dividing the panel 134 into a plurality of sections 140, which cooperatively produce a first message, shown in FIG. 6. Cuts 142 in panel 136 divide the panel 136 into a plurality of sections 144, which cooperatively produce a second message, shown in FIG. 7. As in the previously described embodiments, the panels 134, 136 are movable relative to each other in a substantially horizontal line between a first relative position in FIG. 6 and a second relative position in FIG. 7. As in the FIGS. 4 and 5 embodiment, the cuts 138, 142 have straight portions 146, 148, respectively, in substantially parallel alignment on their respective panel 134, 136. The cut portions 146 on panel 134 are nonparallel with the cut portions 148 on the panel 136 so that the sections 140, 144 do not interfere with each other in transition between the FIG. 6 and FIG. 7 states.

The cuts 138, 142 are configured so that the cut-outs 36, 38, 40, 42 in the earlier-described embodiments can be eliminated. The accomplish this, each cut 138, at it supper end, has a U-shaped portion 150, defining on the panel 134 a U-shaped edge 152 opening towards the left in FIG. 6. The base 154 of each U is offset to the right of each associated straight cut section 138 in FIG. 6. At the bottom of the panel 134 there is a similar U-shaped portion 156 associated with each cut 138. The cut portions 156 define on the panel 134 U-shaped edges 158, opening towards the left in FIG. 6.

On the panel 136, U-shaped cut portions 160, 162 are provided at the top and bottom of the panel 136 and contiguous with the straight portions 148 of each cut 142. Each cut 160 defines on the panel 136 a U-shaped edge 164 opening towards the right in FIGS. 6 and 7, oppositely to the direction of opening of the cut portions 150 on panel 134. Similarly, each cut 162 at the bottom of the panel 136 defines a U-shaped edge 166 opening oppositely to the U-shaped portions 156 on the panel 134.

The cut portions 160, 162 at the top and bottom of panel 136 define flexible panel portions 168, 170 at the top and bottom of the panel 136, which portions 168, 170 cooperate with portions 171, 172 of the panel 134, similarly defined by cut portions 150, 156, to permit the panels 134, 136 to move without binding between the FIG. 6 and FIG. 7 positions. With the panels 134, 136 in the FIG. 7 position, the U's defined by the cut portions 160, 162 on the panel 136 intermesh with the U's 150, 156 on the panel 134 and resultingly the panel portions 168, 170, 171, 172 flex during transition sufficiently to permit the FIG. 6 state to be realized without appreciable binding of the display panels 134, 136. The device 132 otherwise operates similarly to the previously described embodiments.

A further aspect of the invention is the provision of a shield element 174 (FIG. 2) over the front of the display panels 12, 14, to shield the tabs 32, 34 on the panels 14, 12, respectively, from view at the front of the device 10. This is desirable because the tabs 32, 34 will generally not be coordinated with the message on the panels 12, 14 through which they project.

The foregoing disclosure of specific embodiments is intended to be illustrative of the broad concepts comprehended by the invention.

I claim:

1. A display device comprising:

a first display panel having a first forwardly facing substantially flat surface carrying a first message to be displayed, there being a cut in the first display panel to divide the first display panel into a plurality of sections which cooperatively produce said first message, each said section having spaced ends with each said spaced end integrally connected to the first display panel;

a second display panel having a second forwardly facing substantially flat surface carrying a second message to be displayed, there being a cut in the second display panel to divide the second display panel into a plurality of separate sections which cooperatively produce said second message, each said section of the second display panel having spaced ends with each said spaced end on the second display panel integrally connected to the second display panel;

means for guiding movement of one of the first and second display panels in a predetermined path relative to the other of the first and second display panels between a first relative position for said first and second display panels and a second relative position for said first and second display panels; and cooperating means on said first and second display panels for allowing a) intermeshing of said sections on said first and second display panels with the first and second display panels facing forwardly to permit said first message to be exposed for viewing at the front of the display device with the first and second display panels in said first relative position and to permit said second message to be exposed for viewing at the front of the display device with the first and second display panels in said second relative position and b) complete separation of the first and second display panels, each from the other, with the space ends of each of the sections on the first and second display panels integrally connected with their respective display panel, said cooperating means including a tab on one of the plurality of sections on one of the first and second display panels that projects through the cut in the other of the first and second display panels between the spaced ends of the section on the other of the first and second display panels at all times throughout the range of movement of the first and second display panels between said first and second relative positions, said cut on the one display panel having a longitudinal extent and being substantially linear along at least a portion of its longitudinal extent, said one of the first and second display panels being cut to define a tab projecting out of the line of the linear portion of the cut in the one display panel, said tab guiding relative movement of the intermeshed panel sections to prevent binding of the first and second display panels as the first and second display panels are relatively repositioned to selectively display the first and second messages for viewing at the front of the display device, wherein said guiding means comprises means for guiding relative linear movement between the first and second display panels between said first relative position and said second relative position and the tab has a U-shaped configuration opening in the line of relative movement between the first and second display panels with a leading free edge and two edges diverging away from the leading free edge.

2. A display device comprising:

a first display panel defined by a single thickness of sheet material having a first forwardly facing substantially flat surface carrying a first message to be displayed, there being a cut in the first display panel to divide the first display panel into a plurality of sections which cooperatively produce said first message;

a second display panel having a second forwardly facing substantially flat surface carrying a second message to be displayed, there being a cut in the second display panel to divide the second display panel into a plurality of sections which cooperatively produce said second message; and cooperating means on said first and second display panels for intermeshing said display panel sections and for guiding relative movement of said first and second display panel sections along a path between a) a first relative position wherein at least part of a plurality of said first panel sections is in front of the second panel sections so that the first message is exposed for viewing at the front of the display device, and (b) a second relative position wherein at least part of a plurality of said second panel sections is in front of the first panel section so that the second message is exposed for viewing at the front of the display device, said first and second display panels each having first and second ends space transversely of the path of relative movement between the first and second display panels, said cooperating means including a tab on one of the plurality of sections on one of the first and second display panels projecting through the cut in the other of the first and second display panels approximately midway between the ends of the first and second display panels at all times throughout the range of movement of the first and second display panels between said first and second relative positions for guiding intermeshing of the panel sections to prevent binding of the first and second display panels as the first and second display panels are repositioned relative to each other to selectively display the first and second messages for viewing at the front of the display device, wherein said guiding means comprises means for guiding relative linear movement between the first and second display panels between said first relative position and said second relative position, wherein there is a tab on one of the plurality of sections on the first display panel that projects through the cut on the second display panel throughout the range of movement of the first and second display panels between said first and second relative positions and a second tab on one of the plurality of sections on the second display panel that projects through the cut in the first display panel throughout the range of movement of the first and second display panels between said first and second relative position, wherein the cuts on the first and second display panels are at least partially V-shaped with the V-shaped cuts on the first and second panels opening oppositely to each other.

3. The display device according to claim 2 wherein the tab on each of the first and second display panel sections is located at the apex of the V-shaped cut on its respective panel section.

4. A display device comprising;

a first display panel having a first forwardly facing substantially flat surface carrying a first message to be displayed, there being a cut in the first display panel to divide the first display panel into a plurality of sections which cooperatively produce said first message, each said section having space ends with each said space end integrally connected to the first display panel;

a second display panel having a second forwardly facing substantially flat surface carrying a second message to be displayed, there being a cut in the second display panel to divide the second display panel into a plurality of separate sections which cooperatively produce said second message, each said section on the second display panel having spaced ends with each said space end on the second display panel integrally connected to the second display panel;

means for guiding movement of one of the first and second display panels in a predetermined path relative to the other of the first and second display panels between a first relative position for said first and second display panels and a second relative position for said first and second display panels; and cooperating means on said first and second display panels for intermeshing said sections on said first and second display panels with the first and second display panels facing forwardly and to allow said first message to be exposed for viewing at the front of the display device with the first and second display panels in said first relative position and to permit said second message to be exposed for viewing at the front of the display device with the first and second display panels in said second relative position, said first and second display panels capable of a) being intermeshed and placed selectively in said first and second relative positions and b) completely separated, each from the other, with the spaced ends of each of the sections on the first and second display panels integrally connected with their respective display panel, said cooperating means including flexible cooperating portions on each said first and second display panels which cooperating portions remain intermeshed throughout the range of relative movement of said display panels between said first and second display panel positions to prevent binding of the first and second display panels as the first and second display panels are relatively repositioned to selectively display the first and second messages for viewing at the front of the display device, said cooperating portions being defined by said cuts so that there are no cut-puts with material removed in said cooperating portions on said first and second display panels, wherein one of the cuts is configured as a U at each end thereof.

5. The display device according to claim 4 wherein said first and second display panels are movable relative to each other along a substantially linear path between said first and second relative position, and said cooperating portions are defined by a generally U-shape edge opening in the line of said linear path.

6. The display device according to claim 4 wherein there is no cut-out with material removed in either of said display panels, which cut-out is contiguous with said cuts.

7. The display device according to claim 3 wherein said cooperating portions are defined by a generally U-shaped edge with the U's on one display panel opening oppositely to the U's on said other display panel.

8. The display device according to claim 4 wherein said cooperating portions are defined by a generally U-shape edge with U's on one display panel opening oppositely to the U's on said other display panel.

9. The display device according to claim 4 wherein at lest one of said cooperating portions on one of the display panels has a tab that projects through the cut in the other of the display panels throughout the range of relative movement of said display panels between said first and second positions.

10. The display device according to claim 4 wherein said display panels are repositioned between said first and second positions by substantially linear movement therebetween, said cuts have an elongate portion that extends substantially perpendicular to the line of relative movement between said display panels and each said cut has another portion extending angularly with respect to said elongate portion defining one of said cooperating portions.

11. The display device according to claim 4 wherein said cuts have opposite ends and said cooperating portions are defined at the ends of the cuts.

* * * * *

UNITED STATES PATENT AND TRADEMARK OFFICE

CERTIFICATE OF CORRECTION

PATENT NO. : 5,094,022
DATED : March 10, 1992
INVENTOR(S) : Robert K. Rutchik

It is certified that error appears in the above-indentified patent and that said Letters Patent is hereby corrected as shown below:

IN THE ABSTRACT

On the title page, column 1, line 1 of the Abstract, delete "is provided";

lines 5 and 6, delete "which cooperatively produce the first message";

lines 10 and 11, delete "which cooperatively produce the second message";

lines 27-29, delete "throughout the range of movement of the first and second display panels between the first and second positions";

lines 31-32, delete "so that the panels can be moved without binding between said first and second relative positions";

line 33, delete "the need for".

In column 3, line 27, after "cut-outs/reliefs" insert --.--.

UNITED STATES PATENT AND TRADEMARK OFFICE

CERTIFICATE OF CORRECTION

PATENT NO. : 5,094,022
DATED : March 10, 1992
INVENTOR(S) : Robert K. Rutchik

It is certified that error appears in the above-indentified patent and that said Letters Patent is hereby corrected as shown below:

In column 3, line 38, before "invention" insert --present--.

Column 8, Claim 1 , line 41, delete "space" and substitute therefor --spaced--.

Column 9, Claim 2 , line 30, delete "space" and substitute therefor --spaced--.

Column 10, Claim 4 , line 8, delete "space" and substitute therefor --spaced--;

line 9, delete "space" and substitute therefor --spaced--.

line 19, delete "space" and substitute therefor --spaced--.

line 58, delete "puts" and substitute therefor --outs--.

In claim 5, line 4, delete "position" and substitute therefor --positions--.

UNITED STATES PATENT AND TRADEMARK OFFICE

CERTIFICATE OF CORRECTION

PATENT NO. : 5,094,022
DATED : March 10, 1992
INVENTOR(S) : Robert K. Rutchik

It is certified that error appears in the above-indentified patent and that said Letters Patent is hereby corrected as shown below:

Column 11, Claim 9, line 2, delete "lest" and substitute therefor --least--.

Signed and Sealed this

Fourth Day of October, 1994

Bruce Lehman

*Attest:*

BRUCE LEHMAN

*Attesting Officer*

*Commissioner of Patents and Trademarks*